US005501043A

United States Patent [19]

Park

[11] Patent Number: 5,501,043

[45] Date of Patent: Mar. 26, 1996

[54] YARD BARN WITH VINYL ROOF

[75] Inventor: Owen H. Park, Carmel, Ind.

[73] Assignee: Heartland Indusgries, Inc., Carmel, Ind.

[21] Appl. No.: 121,269

[22] Filed: Sep. 14, 1993

[51] Int. Cl.[6] ..... E04B 7/04; E04B 5/14

[52] U.S. Cl. ..... 52/92.1; 52/264; 52/480; 52/545; 52/547; 52/650.3

[58] Field of Search ..... 52/92.1, 264, 270, 52/271, 261, 545, 547, 90.1, 650.3, 480, 690

[56] References Cited

U.S. PATENT DOCUMENTS

| | | | |
|---|---|---|---|
| 507,680 | 10/1893 | Hodsdon | 52/92.1 |
| 1,627,805 | 5/1927 | Richards | 52/90.1 |
| 1,665,774 | 4/1928 | Conway | 52/545 X |
| 1,959,880 | 5/1934 | Sims | 52/262 |
| 2,184,328 | 12/1939 | Wildman | 52/545 X |
| 2,922,385 | 1/1960 | Murray | 52/94 |
| 3,254,460 | 6/1966 | Bowser | 52/94 |
| 3,261,132 | 7/1966 | Miller | 52/92.1 |
| 3,283,693 | 11/1966 | Howell | 52/90.1 X |
| 3,380,215 | 4/1968 | Schaeffer et al. | 52/549 X |
| 3,411,259 | 11/1968 | Anderson et al. | 52/531 |
| 3,520,099 | 7/1970 | Mattes | 52/531 |
| 3,925,938 | 12/1975 | Molen | 52/480 |
| 4,189,882 | 2/1980 | Harrison et al. | 52/222 |
| 4,332,117 | 6/1982 | Quinnell | 52/94 |
| 4,481,744 | 11/1984 | Park | 52/92.1 |
| 4,573,293 | 3/1986 | Park | 52/92.1 |
| 4,672,788 | 6/1987 | VanTosh | 52/520 X |
| 4,696,133 | 9/1987 | Wren et al. | 52/2.17 X |
| 4,854,101 | 8/1989 | Champagne | 52/545 |
| 4,947,609 | 8/1990 | Champagne | 52/545 |
| 4,967,520 | 11/1990 | Post, Jr. et al. | 52/79.5 |
| 5,022,211 | 6/1991 | Scott | 52/690 X |
| 5,293,725 | 3/1994 | Matticks | 52/271 |
| 5,375,381 | 12/1994 | Park et al. | 52/92.1 |

FOREIGN PATENT DOCUMENTS

| | | | |
|---|---|---|---|
| 150866 | 9/1920 | United Kingdom | 52/92.1 |
| 2098641 | 11/1982 | United Kingdom | 52/90.1 |

*Primary Examiner*—Carl D. Friedman
*Assistant Examiner*—Laura A. Saladino
*Attorney, Agent, or Firm*—Barnes & Thornburg

[57] ABSTRACT

A kit for constructing a yard barn comprising: a roof structure comprising, a plurality of elongated vinyl sheets of the type used as horizontally extending siding with each sheet having an upper and lower longitudinal curved edge created for interengaging locking one sheet to an adjacent sheet; a plurality of rafters supporting the vinyl sheets which are attached directly to the rafters; fasteners for attaching the vinyl sheets to the rafters; the rafters being composed of two angled members connected at their ends; a floor structure comprising a pair of prefabricated deck assemblies of reduced weight and size, each deck assembly comprising a network of joists attached at their ends to a side rail to form a support skeleton having an upper surface; a deck panel attached to the upper surface of the support skeleton; the network of joists having first joists attached at their ends orthagonal to the side rails, with intermediate joists extending between the first joists and with still further joists extending between the intermediate joists and the side rails, wherein the joists all are of a lesser height than the side rails to reduce weight; and wherein the deck is also connected to the joists to extend completely over one of the first joists and partial over another of the first joists so that the sections can be joined together with the deck of one section over the first joist of another section in abutting relationship to the deck of the other section; and side walls and end walls to be connected between said roof structure and said floor structure.

20 Claims, 4 Drawing Sheets

YARD BARN WITH VINYL ROOF

BACKGROUND AND SUMMARY OF THE INVENTION

The present invention relates to buildings for use in storing personal effects, and particularly to yard buildings. More particularly, the invention relates to yard buildings having a modular floor structure suitable for use as a pallet during shipment of the yard building to the ultimate consumer and a roof covered by vinyl sheets of translucent house siding material.

Yard buildings have become popular in recent years because they provide neat, secure, and weatherproof storage. Many homeowners purchase them for storing lawn equipment, bicycles, and other household items they don't want in the house or garage.

Typically, the yard buildings are sold to be assembled in the purchaser's location. The manufacturer typically precuts the studs, rafters, and joists, and supplies doors and panels to be used as roof panels, floor panels, and side walls. The manufacturer also typically supplies the roofing shingles. These pieces are typically picked up at the manufacturer's plant by a carpenter and carried by truck to the purchaser's location to be assembled on site.

Taken together, the parts and pieces of the prior art buildings add up to a lot of weight. The shipping weight of the building directly affects the shipping charges for sending a kit to the purchaser's location, and therefore directly affects the cost of the kit to the consumer. Thus, there is a need to provide a yard building with a structure that is strong, rigid, and attractive and yet light in weight for shipment and handling.

Manufacturers have sought for years to reduce the shipping weight of yard buildings through the implementation of various weight reduction measures. Unfortunately, some weight reduction measures can potentially compromise the structural strength and rigidity of the final building. Preferably, any weight reduction measures undertaken do not compromise the strength and rigidity of the final building. A kit that maintains the strength and rigidity of the finished building while reducing the overall shipping weight of the building kit shipped to the purchaser's home would be a substantial improvement over conventional yard buildings.

Another problem encountered by yard buildings is temperature buildup inside the building when the building is closed. Generally, the temperature buildup is due to sunlight beating down directly on the dark, conventional shingle roof, the heat from the roof being transferred to the interior of the building. Various ventilation methods have been tried, but they rely on mother nature, in the form of wind, to cool the building after it becomes hot. A white or light colored vinyl roof that reduces the amount of heat transferred into the interior on the building, and especially one that reduces the shipping weight of the kit, would be welcomed by manufacturers and consumers alike.

According to the present invention, a yard building having side walls and a longitudinal axis includes a floor structure coupled to the side walls and a plurality of rafters coupled to the side walls and to each other to provide a roof structure. A plurality of longitudinally extending vinyl sheets is attached to the roof structure. Each vinyl sheet includes an upper longitudinal edge and a lower longitudinal edge, and each lower longitudinal edge includes means for engaging the upper longitudinal edge of an adjacent sheet.

In preferred embodiments, the building includes a starter panel extending longitudinally along the lower edge of the roof structure. The starter panel is attached to a top plate which is conventionally coupled to the side wall. The starter plate overhangs at least a portion of a side wall and includes means for receiving the engaging means of the lowest vinyl sheet on the roof structure.

The roof structure further includes a pair of roof sections joined together to form a peaked ridge. The vinyl sheets extend along the roof sections and are joined to each other, lower edge-to-upper edge, to cover the roof structure. Both roof sections include an uppermost vinyl sheet which meet at the peaked ridge. A ridge clip extends parallel to the vinyl sheets and is coupled to the uppermost vinyl sheet of each roof section, thereby sealing the peaked ridge.

Advantageously, the vinyl sheets can be made from translucent vinyl siding material or white vinyl which is somewhat translucent. Translucent material allows some light inside the building, yet reduces the heat buildup in the building. At the same time, vinyl sheets reduce the weight of the roof sections to provide a reduced shipping weight for the building kit.

The floor structure includes a plurality of floor sections. Each floor section includes a plurality of intermediate joist members, a plurality of side joist members, and a plurality of outer joist members. The intermediate joist members are positioned in parallel spaced-apart relation to each other, and the plurality of side joist members is attached to the intermediate joist members. The side joist members are positioned in parallel space-apart relation to each other and are oriented orthogonally to the intermediate joist members. The plurality of outer joist members is attached orthogonally to the intermediate joist members, and the plurality of side rail members is attached orthogonally to the side joist members and the outer joist members. Advantageously, the floor sections are sized to provide shipping pallets for shipment of the building to a purchaser's location.

According to one aspect of the invention, the side rail members have a first height dimension and the intermediate and side joist members have a second height dimension that is less than the first height dimension. The outer joist members have a third height dimension that is less than the first height dimension. The reduced height dimensions of the joist members cooperate to reduce the weight of the floor structure. Thus, the invention advantageously provides reduced weight shipping pallets.

By providing a roof made from translucent vinyl sheets, the present invention reduces the heat buildup inside the yard building and reduces the shipping weight of the building. By providing floor sections having predetermined dimensions and members with reduced size dimensions, the present invention further reduces the shipping weight. Sizing the floor sections to be used as pallets provides integral shipping pallets and further reduces the shipping weight and overall cost of the building.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figures 1, 2, 3, 4:
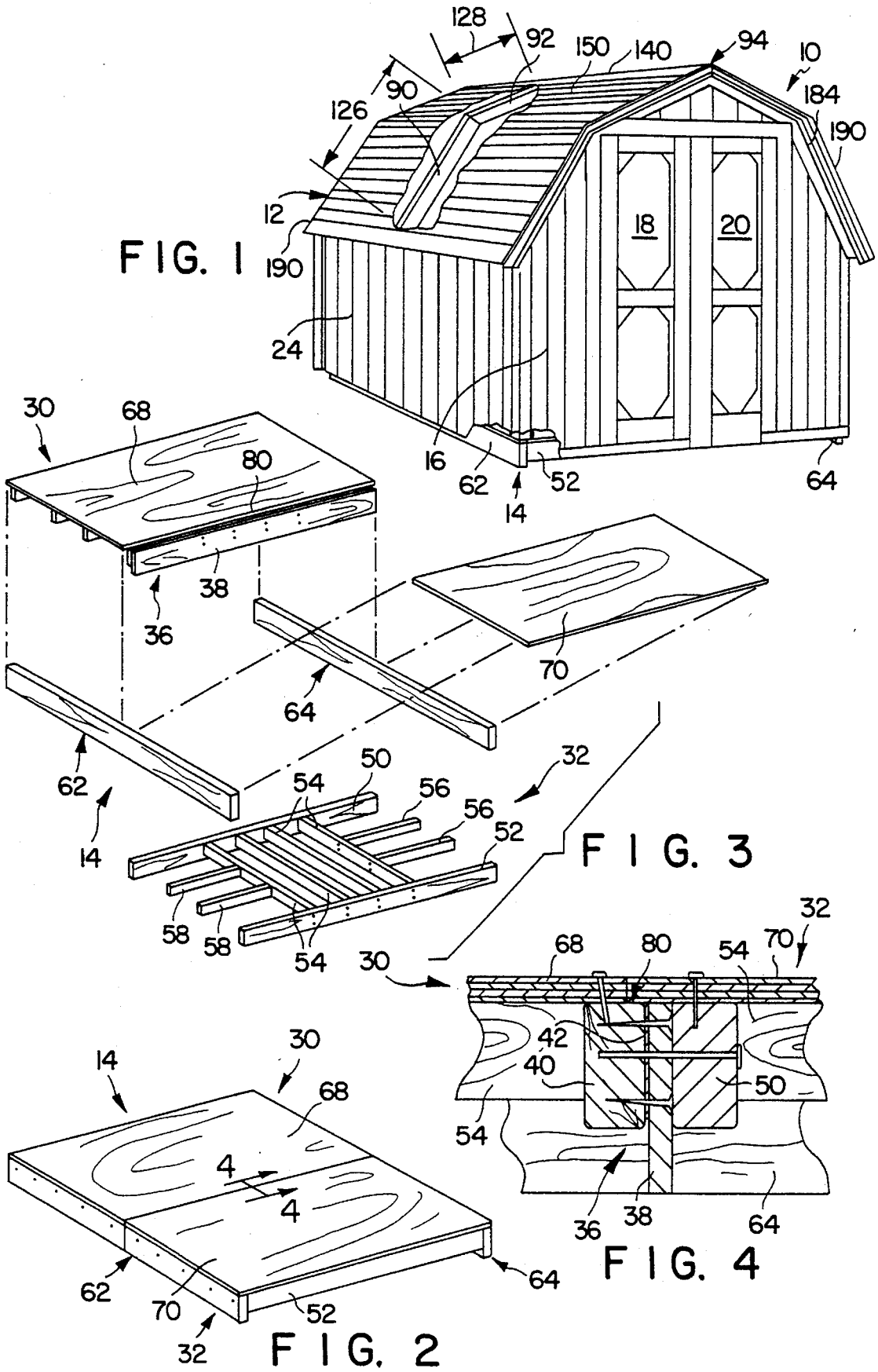
FIG. 1 is a perspective view of a yard barn, partially cut away, showing the structure that is assembled from the kit of the present invention.
FIG. 2 is the completed floor structure of the yard barn of FIG. 1.
FIG. 3 is an exploded perspective view of the floor structure of FIG. 2.
FIG. 4 is a fragmentary sectional view taken along the lines 4—4 of FIG. 2 and enlarged.

The yard barn 10 of the present invention is shown in perspective in FIG. 1 to illustrate the end product that will result from assembling the kit components of the present invention. The kit comprises a roof structure 12 and a floor structure 14 which will be described in more detail hereinafter. The barn 10, of course, will have a front end wall 16 which will have the conventional rectangular opening which may be closed by the illustrated doors 18, 20 or a single door. A rear wall 22 shown best in FIGS. 5 and 6 will be provided at the rear end of the barn, and a pair of side walls 24, only one of which is shown, will complete the barn structure.

The floor structure 14, as shown in considerable detail in FIGS. 2–4, is essentially a prefabricated or partially prefabricated deck assembly of reduced weight and size comprising a plurality of transverse members (illustratively first and second floor sections 30, 32) with a network of joists attached therebetween to form a support skeleton. A deck or floor panel is attached to the top of each support skeleton to form a deck assembly. In the illustrative embodiment, each of the first and second floor sections 30, 32 essentially is a subassembly prefabricated or partially prefabricated in the factory as illustrated in FIGS. 2–4. First of all, the illustrative embodiment includes a joining joist member 36 which is illustratively made with a very straight and inexpensive particle board plate 38 (FIG. 4) to which is attached a 2"×4" frame member 40 by means of a glue layer 42 and conventional nails. This joining joist member 36 essentially attaches two floor sections subassemblies 30, 32 together when they are taken out of the kit and assembled. With an exception to be noted in connection with the overlapping decks discussed hereinafter, the joist networks or support skeletons of the floor sections 30, 32 are essentially identical such that only one skeleton will be discussed in detail. The illustrative skeleton for the floor section 32 comprises outer joists 50, 52 which are connected together by a plurality (illustrated as four) intermediate joists 54. Two side joists 56 are attached to one outboard intermediate joist 54 and two side joists 58 are attached to the other outboard intermediate joist 54 as illustrated in FIG. 3. The support skeleton is sized and shaped to receive and support a 4'×8' plywood deck cover or floor panel. The two floor sections 30, 32 are joined together as best illustrated in FIG. 4 utilizing the joining joist member 36 and further held together by skids or side rail members 62, 64 which are conventionally provided on yard barns. Illustratively, the joist members 54, 56 may be 2"×3" board members while the outer joists 52, 54 may be 2"×4" board members. The side rails or skids 62, 64 may illustratively be 2"×6" board members. This illustrative design is to lower the weight of the floor structure 14.

In some cases, it may be advantageous completely to prefabricate one or more floor sections 30, 32 in the factory and to leave the other floor section 30, 32 partially fabricated.

The floor panels or floor decks are indicated at 68, 70, respectively, for the floor sections 30, 32. As best seen in FIG. 4, the panel 68 is placed slightly to the left of the upper edge of the joining joist member 36 to provide an offset 80. Then, the panel 70 is placed slightly to the left on the floor section 32 to overlap the offset. This offset arrangement eliminates a direct path from the surface of the floor decks 68, 70 to the ground as a barrier to insect travel.

This floor structure 14 assembled in the fashion illustrated and discussed above provides a very strong and light-weight floor structure which can be prefabricated in two separate sections in the factory and placed in a shipping container for shipment to the job site. When assembled, for example, the floor structure 14 will be a substantial 8'×8' or 8'×12' floor structure for the yard barn 10 with side rails or skids 62, 64 supporting the floor structure and the yard barn 10 on the ground. The kit will include studs 76 for the side walls and end walls which will be used in conventional fashion with a top plate 78 (FIG. 7) mounted to the studs at the upper edge of the side walls 24 in conventional fashion.

Figure 7:
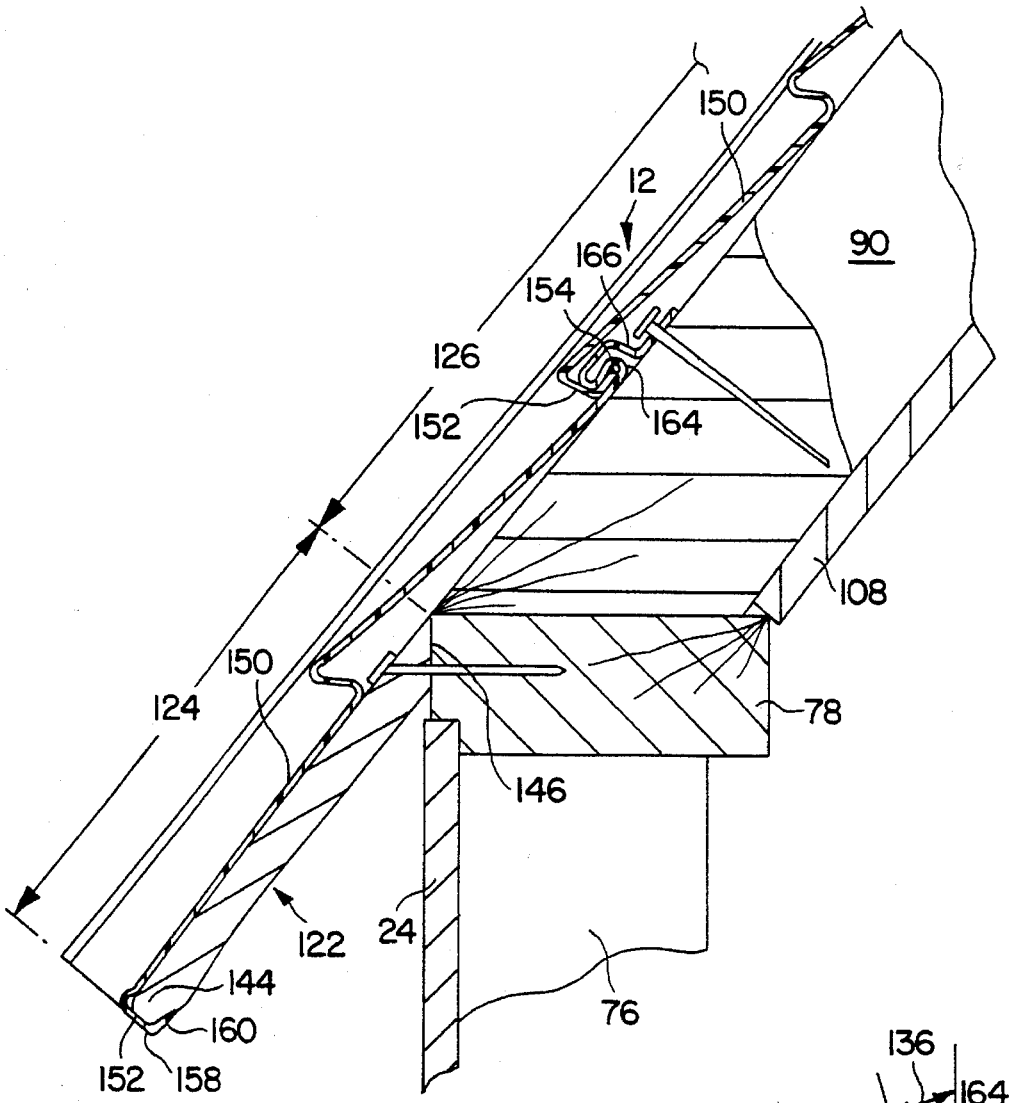
FIG. 7 is an enlarged fragmentary sectional view showing how the vinyl sheets are attached directly to the rafters without the conventional decking on the rafters.
Figure 6:
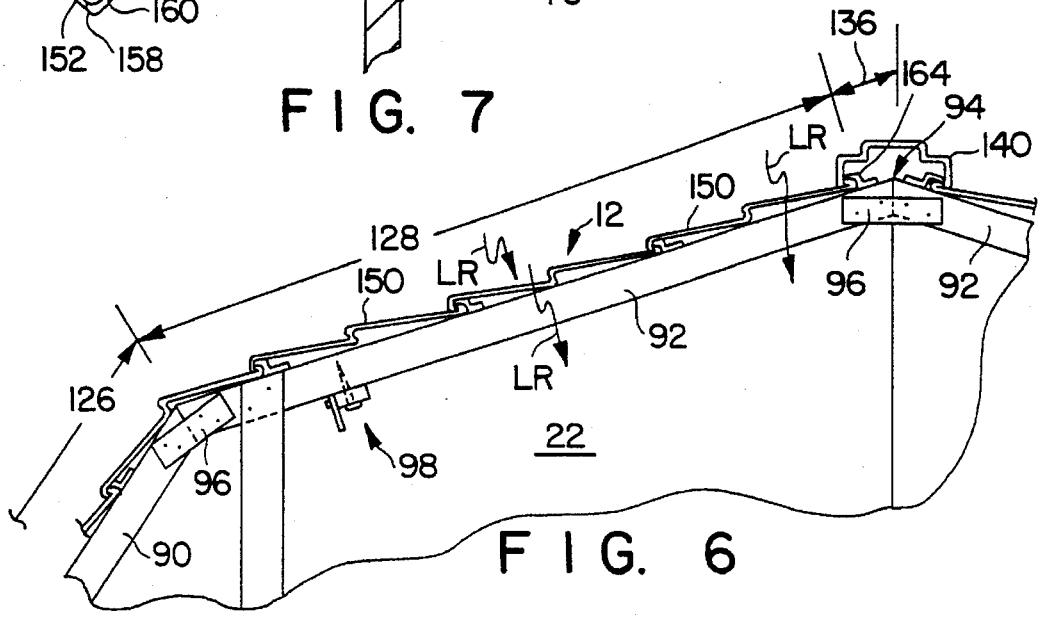
FIG. 6 is a fragmentary end view, inside the yard barn, showing the truss/rafter assembly with the vinyl roof.
Figure 5:
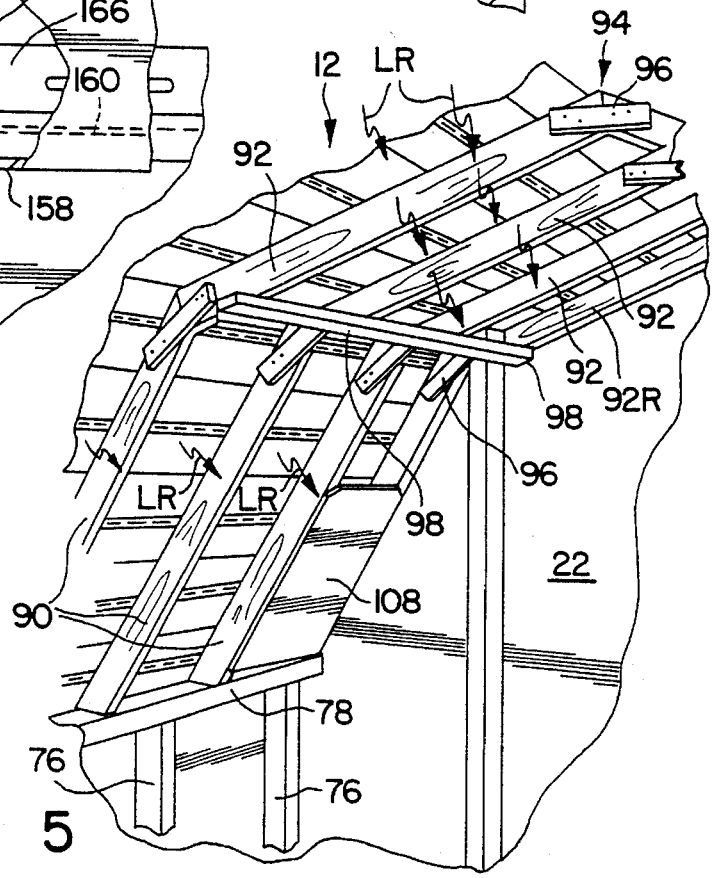
FIG. 5 is a fragmentary perspective view showing the inside of the yard barn of FIG. 1.

The kit of the present invention will include a roof structure 12 which will be mounted on the side walls 24 (top plates 78) as illustrated best in FIGS. 5, 6 and 7. The roof structure 12 comprises a plurality of truss/rafter assemblies (portions of which are best shown in FIG. 5) comprising a plurality of lower rafters 90 each of which rests, at its lower end, on the plate 78, and upper rafters 92. Each upper rafter 92 meets, at its upper end, with another upper rafter 92 from the other side of the roof structure 14 to form the peak or ridge 94. These rafters 90, 92 are conventionally joined together by truss plates 96 and conventional fastening elements.

Figure 9:
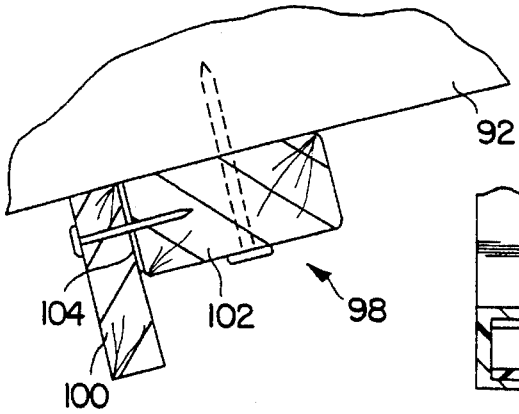
FIG. 9 is a fragmentary sectional view showing a stringer assembly that holds the truss/rafter assemblies.

The truss/rafter assemblies (lower rafters 90 and upper rafters 92) are held in alignment by a stringer assembly 98 shown in FIGS. 5 and 9. The illustrative stringer assembly comprises an elongated particle board plate 100 (FIG. 9) to which is attached a 2"×4" stringer board 102 with a glue joint therebetween as indicated at 104 and with appropriate nails. The particle board 100 can be obtained to be very straight, and will straighten the 2"×4" board 102 attached thereto. This stringer assembly 98 would preferably be prefabricated and placed in the kit of the present invention.

In addition to the stringer assemblies 98, one on each side of the interior of the yard barn 10, the kit illustratively includes four anti-racking plates 108 (only one of which is shown in FIG. 5) to be placed on each of the four corners of the interior of the barn as best seen in FIG. 5. These plates 108 are attached to the rafters 90 on the sides opposite to the sides to which the vinyl sheets are directly attached as will be described hereinafter. These anti-racking plates may be obtained from trimming off of the paneling which provides the front end wall 16 and corresponding rear end wall 22.

As best seen in FIG. 7, an elongated starter panel 122 is attached to the upper plate 78 on each side of the barn 10 to extend therealong to have its upper surface flush with the upper surfaces of the lower rafters 90. This starter panel 122 has a dimension indicated at 124 which is rather critical for reasons which will become clear hereinafter. Similarly, the length of the rafters 90, 92 is rather critical to provide the dimensions 126, 128 (FIGS. 1, 6 and 7) to accommodate the vinyl roof made from vinyl siding strips or sheets. Another dimension 136 is indicated in FIG. 6 which is one-half of the coupling dimension between the uppermost vinyl sheets to be attached to the rafters 90, 92. When these dimensions are correct, as contemplated by the present invention, an extruded vinyl ridge seal 140 will join the upper edges of the uppermost vinyl sheets on each roof section.

Referring still to FIG. 7, it will be seen that the starter panel 122 has a lower longitudinal edge 144 which is beveled or reduced and an upper edge 146 cut at an angle to complement the outer edge of the plate 78 for attachment purposes. Conventional nails are driven horizontally through the starter panel 122 and into the plate 78

The plurality of vinyl sheets 150 is then attached to each side of the roof structure 12 starting first with the lowermost vinyl sheet 150 which is attached to the starter panel 122 as best illustrated in FIG. 7. Each vinyl sheet or vinyl strip 150 is conventionally elongated to have a lower edge locking means 152 and an upper edge locking means 154 which is very conventional in the industry. As shown in FIG. 7, the lower edge locking means 152 includes edge portions 158 and 160 providing an open groove or hook which receives the lower edge 144 of the starter panel 122. This lower edge connection between the lowermost vinyl strip 150 and the starter panel 122 may be sealed with adhesive or caulking as desired.

Figure 8:
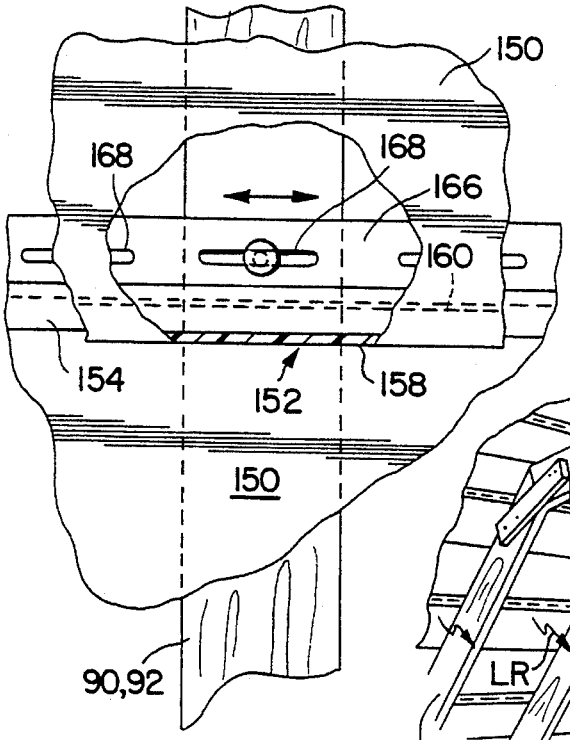
FIG. 8 is an enlarged fragmentary view, partially cutaway, showing more details concerning the attachment of the vinyl sheets or strips to the rafters.

The upper edge locking means 154 of each vinyl strip is conventionally formed to provide a downwardly facing elongated groove 164 and a nail flange 166. These vinyl sheets or strips 150 are mounted directly to the rafters 90, 92 without any decking therebetween by means of nails which extend through the provided elongated nail slots 168 (FIG. 8). It will be appreciated that once the lowermost vinyl sheet 150 is applied to each side of the roof structure 12, the rest of the vinyl sheets 150 are applied to the roof structure 12 in the same way that vinyl sheets are applied to sides of buildings. The lowermost edge of each vinyl sheet 150 is hooked or engaged with the uppermost edge of the subjacent sheet. When the uppermost vinyl sheet 150 on each side of the roof structure 12 approaches the ridge 94, there is a gap as seen in FIG. 6 which is enclosed by the vinyl extrusion 140 which is formed to have an elongated flange on each side to be received in the grooves 164. This illustrative extrusion 140 is designed to seal the upper ridge 94 of the roof structure 12 in accordance with the present invention.

The present invention contemplates that a kit will be provided comprising a roof structure 12 with the truss/rafter assemblies to be mounted as shown generally in FIG. 5 with the truss/rafter assemblies held in position by the stringer assemblies 98 and anti-racking plates 108. In some cases, advantageously, translucent vinyl sheets 150 will be used so that light rays (indicated at LR) will illuminate the barn 10 interior. This would not be possible with the vinyl resting on conventional roof decking which is, in turn, on the rafters.

Figure 10:
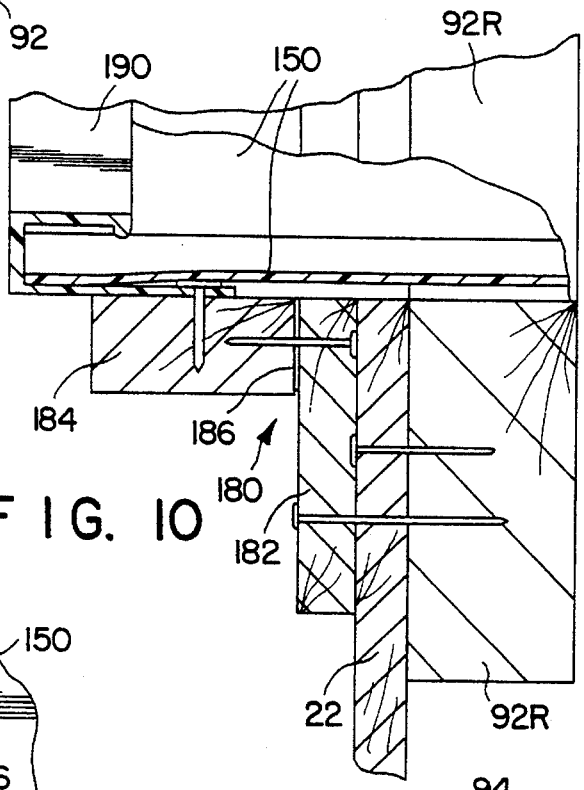
FIG. 10 is an enlarged fragmentary sectional view showing how the ends of the vinyl strips are sealed

The illustrative yard barn 10 may include a soffit assembly of the type indicated at 180 in FIG. 10, i.e., a strip cover arrangement for the cut ends of the vinyl sheets 150. The illustrative soffit assembly 180 comprises a prefabricated assembly including the elongated particle board 182 (FIG. 10) to which is attached a soffit plate 184 by means of the glue indicated at 186 and the conventional nails.

As best shown in FIG. 10, the soffit assembly 180 is mounted to the rear wall with nails which penetrate into the rear rafter 92R (the rearwardmost truss/rafter assembly) such that the soffit plate will extend upwardly and along the rafter to provide support for the ends of the vinyl sheets 150. A J-molding strip 190 is provided and attached to the soffit plate 194 by nails as shown to receive the cut ends of the vinyl sheets.

Figure 11:
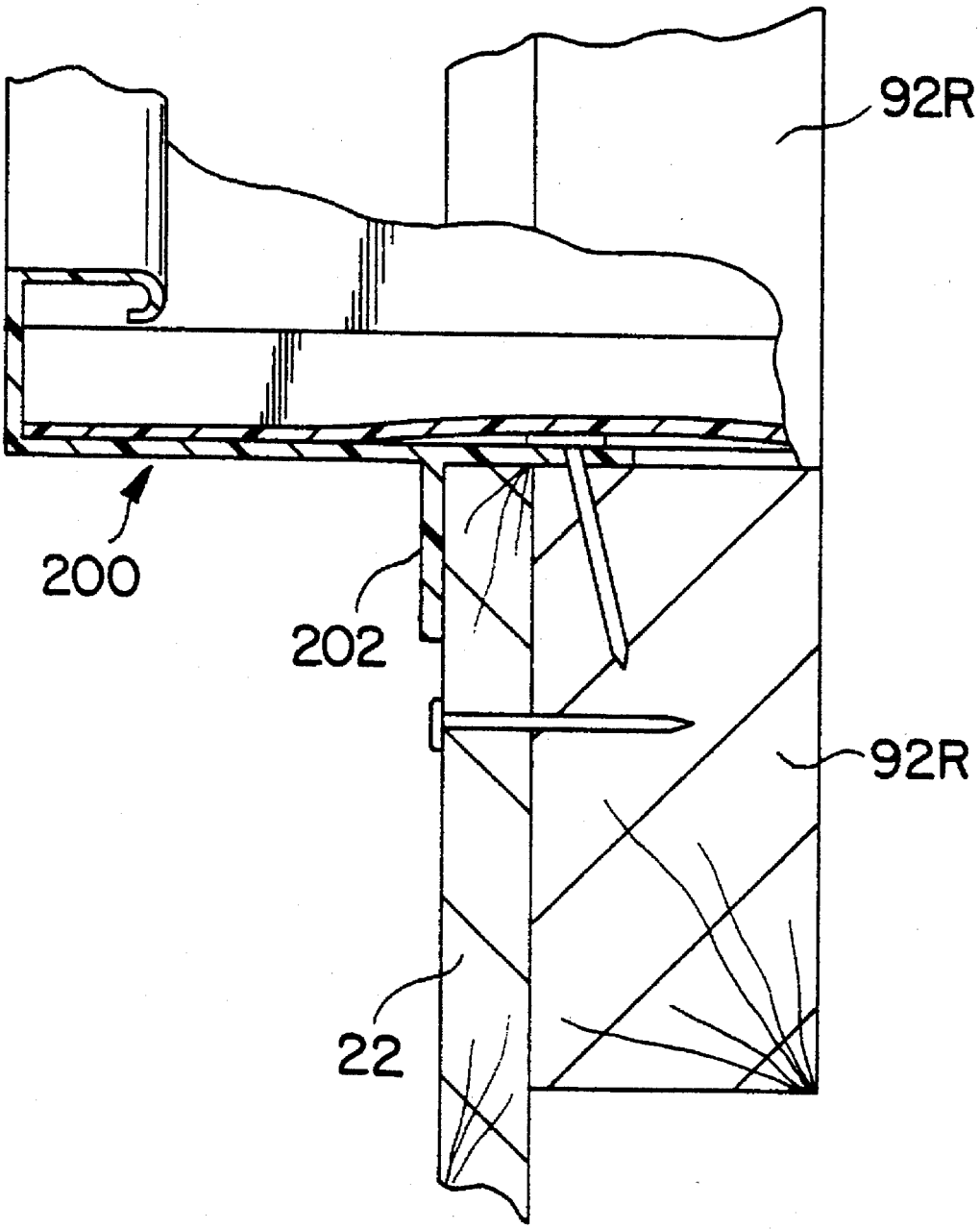
FIG. 11 is an enlarged fragmentary sectional view showing another embodiment of the structure shown in FIG. 10.

Referring to FIG. 11, it will be seen that a different embodiment of the J-molding 200 is shown with the concept of eliminating the soffit assembly 180. In FIG. 11, the J-molding is provided with a downwardly extending flange 202 as indicated to provide the required sealing.

The kit of the present invention preferably includes a number of prefabricated assemblies which will permit the yard barn 10 to be assembled and to be straight in appearance and rigid in structure. Such prefabricated assemblies as the joining joist member 36 shown in FIG. 4, the stringer assembly 98 shown in FIG. 9, and the soffit assembly 180 shown in FIG. 10, are prefabricated to include a very straight and structurally strong particle board strip to which is glued and fastened a conventional 2"×4" board or other board which would not, in a typical mill run, be as straight and effective.

Although the invention has been described in detail with reference to a certain preferred embodiment, variations and modifications exist within the scope and spirit of the invention as described and defined in the following claims.

I claim:

1. A yard building having side walls comprising side paneling, studs and a top plate, and a longitudinal axis, the building comprising:

a floor structure coupled to the side walls, a plurality of rafters coupled to the side walls and to each other to provide a roof structure, a plurality of similarly shaped longitudinally extending vinyl sheets attached directly to the rafters of the roof structure, each sheet having an upper longitudinal edge and a lower longitudinal edge, each lower longitudinal edge including means for engaging the upper longitudinal edge of an adjacent sheet, the top plates attached to the rafters and means for attaching a lower longitudinal edge of a first vinyl sheet of the plurality of vinyl sheets to the roof structure, the attaching means being coupled to the top plate and overhanging at least a portion of the side wall and wherein the engaging means of the lower longitudinal edge of the first vinyl sheet encircles a portion of the attaching means.

2. The building of claim 1, wherein the attaching means includes a starter panel extending longitudinally along the roof structure, the starter panel being gripped by the engaging means formed on the first vinyl sheet.

3. The building of claim 2, wherein the encircled portion of the attachment means includes a beveled edge formed on the starter panel, the beveled edge being configured to conform to the shape of the engaging means formed on the first vinyl sheet.

4. The building of claim 1, wherein the roof structure includes a pair of roof sections joined together to form a peaked ridge, each section having an uppermost vinyl sheet attached thereto, the building further including a ridge clip including means for receiving the upper edge of the uppermost vinyl sheets on each roof section.

5. The building of claim 1, further including end walls for the building, and a one piece soffit member, the soffit member including means for receiving the plurality of vinyl sheets and means for sealing the juncture between the end walls and the roof structure.

6. The building of claim 5, wherein the soffit member includes a J-shaped member having a straight portion and a facia portion, the straight portion having a first side positioned adjacent the vinyl sheets and a second side, and the facia portion extending orthogonally from the second side.

7. The building of claim 1, wherein the floor structure includes a plurality of floor sections, each floor section including a plurality of intermediate joist members positioned in parallel spaced-apart relation to each other, a plurality of side joist members attached to the intermediate joist members, the side joist members being positioned in parallel space-apart relation to each other and oriented orthogonally to the intermediate joist members, a plurality of outer joist members attached orthogonally to the intermediate joist members, and a plurality of side rail members attached orthogonally to the side joist members and the outer joist members, the side rail members having a first height dimension and the intermediate and side joist members having a second height dimension less than the first height dimension to reduce the weight of the floor structure.

8. The building of claim 7, wherein the plurality of floor sections are joined together to form a single floor structure and includes means for joining adjacent floor sections together.

9. The building of claim 8, wherein the floor sections include floor surface members attached to the joist members, and wherein the joining means includes a joining joist member abutting an outer joist member of at least one of the floor sections.

10. The building of claim 1 wherein, the side walls, floor structure and roof structure cooperating to define an interior region, the vinyl sheets being translucent for reducing heat buildup in the interior region.

11. The building of claim 10, wherein the translucent vinyl sheets extend parallel to the longitudinal axis of the building.

12. The building of claim 10, wherein the roof structure includes at least two panels, each panel having a plurality of vinyl sheets including an uppermost vinyl sheet, all the uppermost vinyl sheets cooperating with each other to define a peak ridge extending parallel to the longitudinal axis of the building, and means for sealing the peak ridge, the sealing means extending along the length of the peak ridge and being coupled to an upper longitudinal edge of the uppermost vinyl sheet of each panel.

13. The building of claim 12, wherein the sealing means includes a ridge clip extruded from the translucent material of the vinyl sheet.

14. The building of claim 10, wherein the rafters include upper and lower portions, an upper end of each lower portion being attached to a lower end of an upper portion, the rafters being divided into first and second groups and the upper ends of the upper portions of the first group of rafters are joined to the upper ends of the upper portions of the second group of rafters to define a peak ridge, and the vinyl sheets having longitudinally extending upper and lower halves and a longitudinally extending bend disposed between the upper and lower halves.

15. The building of claim 14, wherein the upper and lower rafter portions are sized to have a predetermined length orthogonal to the longitudinally extending vinyl sheets so that a predetermined number of vinyl sheets fit along each of the lower and upper portions.

16. The building of claim 10, wherein the building is shipped to a purchaser in the form of a kit, the floor structure includes a plurality of floor sections, each floor sections including a floor surface and means for supporting the floor surface, the supporting means being manufactured from light weight materials, the floor sections defining lightweight shipping pallets for supporting the kit during shipment.

17. The roof structure of claim 1 further comprising means for maintaining the structural alignment of the rafters, said maintaining means being fastened to the undersides of the rafters opposite to upper sides of the rafters to which the vinyl sheets are directly fastened.

18. A yard building having side walls and a longitudinal axis, the building comprising:

a roof structure coupled to the side walls, a plurality of floor sections coupled to the side walls, each of the floor sections including a panel member, a plurality of side rail members and a plurality of elongated outer joist members, the side rail and outer joist members having predetermined length, height and width dimensions, the side rail members having a first height dimension and the outer joist members having a second height dimension, the second height dimension being less than the first height dimension, each of the outer joist members having both of their ends buttingly connected to the side rail members, the panel member abutting directly on both the joist members and the side rail members and means for joining the plurality of floor sections together in an abutting side-by-side relationship.

19. The building of claim 18, wherein each floor section includes a plurality of intermediate joist members positioned in parallel spaced-apart relation to each other, a plurality of side joist members attached to the intermediate joist members, the side joist members being positioned in parallel space-apart relation to each other and oriented orthogonally to the intermediate joist members, the plurality of outer joist members attached orthogonally to the intermediate joist members, and the plurality of side rail members attached orthogonally to the side joist members and the outer joist members, the intermediate and side joist members having a third height dimension, the third height dimension being less than the second height dimension.

20. The building of claim 19, wherein the floor sections include floor surface members joined together to form a single floor surface and the means for joining includes a joining joist member abutting an outer joist member of at least one of the floor sections.

* * * * *